United States Patent [19]

Massonnet

[11] 4,447,087

[45] May 8, 1984

[54] TWO-POSITION EASY CHAIR

[76] Inventor: Henry Massonnet, FR - 01760, Nurieux, France

[21] Appl. No.: 342,865

[22] Filed: Jan. 26, 1982

[30] Foreign Application Priority Data

Feb. 9, 1981 [FR] France ..... 81 02621

[51] Int. Cl.[3] ..... A47C 13/00

[52] U.S. Cl. ..... 297/130; 297/345

[58] Field of Search ..... 297/345, 327, 328, 344, 297/346, 130

[56] References Cited

U.S. PATENT DOCUMENTS

| | | | |
|---|---|---|---|
| 244,014 | 7/1881 | Williams | 297/130 X |
| 606,612 | 6/1898 | White | 297/328 |
| 1,252,751 | 1/1918 | Weatherford | 297/328 |
| 2,544,800 | 3/1951 | Michaelis | 297/328 |
| 2,767,774 | 10/1956 | Derby | 297/345 X |
| 2,829,704 | 4/1958 | Hallett et al. | 297/328 X |
| 2,952,302 | 9/1960 | Mittlieder | 297/327 |

FOREIGN PATENT DOCUMENTS 318157 11/1953 Switzerland .

*Primary Examiner*—James T. McCall

*Attorney, Agent, or Firm*—Dowell & Dowell

[57] ABSTRACT

The invention relates to an easy chair having two positions. Its support comprises two frames connected together by spacers. The arm of each frame is provided with two notches. The longitudinal elements of the seat position each comprise a notch and a projection, while the uprights of the backrest are provided with a hook and a stop. When the notches in the longitudinal elements cooperate with a spacer located between the front legs of the support and the stops of the backrest cooperate with the rear notches in the arms, the easy chair is in low position. In high position, the projections at the front of the longitudinal elements are retained by the notches at the front of the arms of the support and the hooks behind the backrest abut around a spacer located between the rear legs at the top thereof. The invention is more particularly applicable to garden and outside furniture.

5 Claims, 6 Drawing Figures

Fig. 4
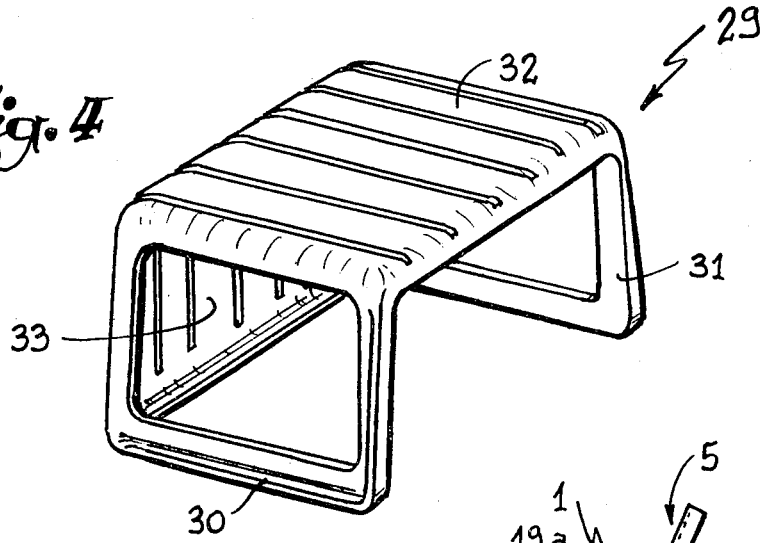
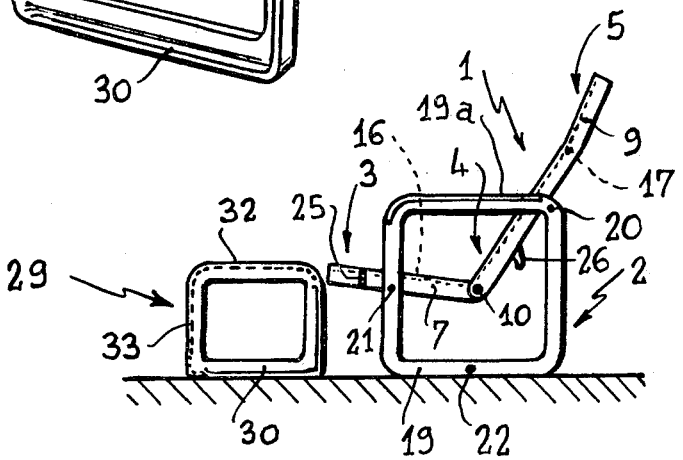
Fig. 5
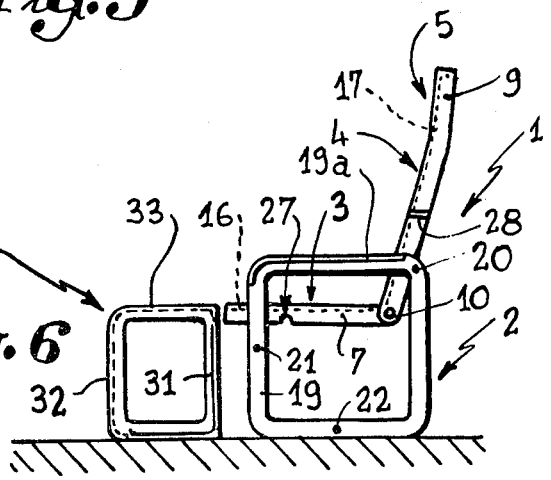
Fig. 6

TWO-POSITION EASY CHAIR

The present invention relates to improvements in easy chairs which are used on terraces, in the garden and elsewhere in the open air.

Easy chairs of the type in question are generally arranged so that their backrest is so inclined with respect to the seat surface that the user is tipped backwards to a considerable extent and is sitting relatively near the ground. It will be readily appreciated that such easy chairs cannot be used around a table if users wish to use a table for one reason or another. Under these circumstances, a second set of chairs must be provided, of suitable height with respect to a table and having a relatively upright backrest. This involves appreciable extra costs and storage difficulties due to the increase in the volume of articles to be stowed away during the winter months.

It is an object of the improvements according to the present invention to remedy these drawbacks and to enable an easy chair to be produced which comprises two positions: a rest position and an upright position for use around a table; in addition, the easy chair according to the invention is made of rot-proof material and, if necessary, can be left outside in all seasons.

The easy chair according to the invention comprises two pivotally connected parts, one constituting the seat portion and the other the backrest, its support being provided with means for supporting the two pivoted parts in two different positions thereof, i.e. in the first of these positions, the seat portion is low and the backrest is relatively tipped backwards, whilst the second position corresponds to a higher position of the seat surface with the backrest more upright.

The invention will be more readily understood on reading the following description with reference to the accompanying drawings, in which:

FIG. 4 is a view in perspective of a footrest according to the invention, provided to cooperate with the easy chair in its two positions.

FIGS. 5 and 6 illustrate how the footrest is used in the two positions of the easy chair according to the invention.

Figure 1:
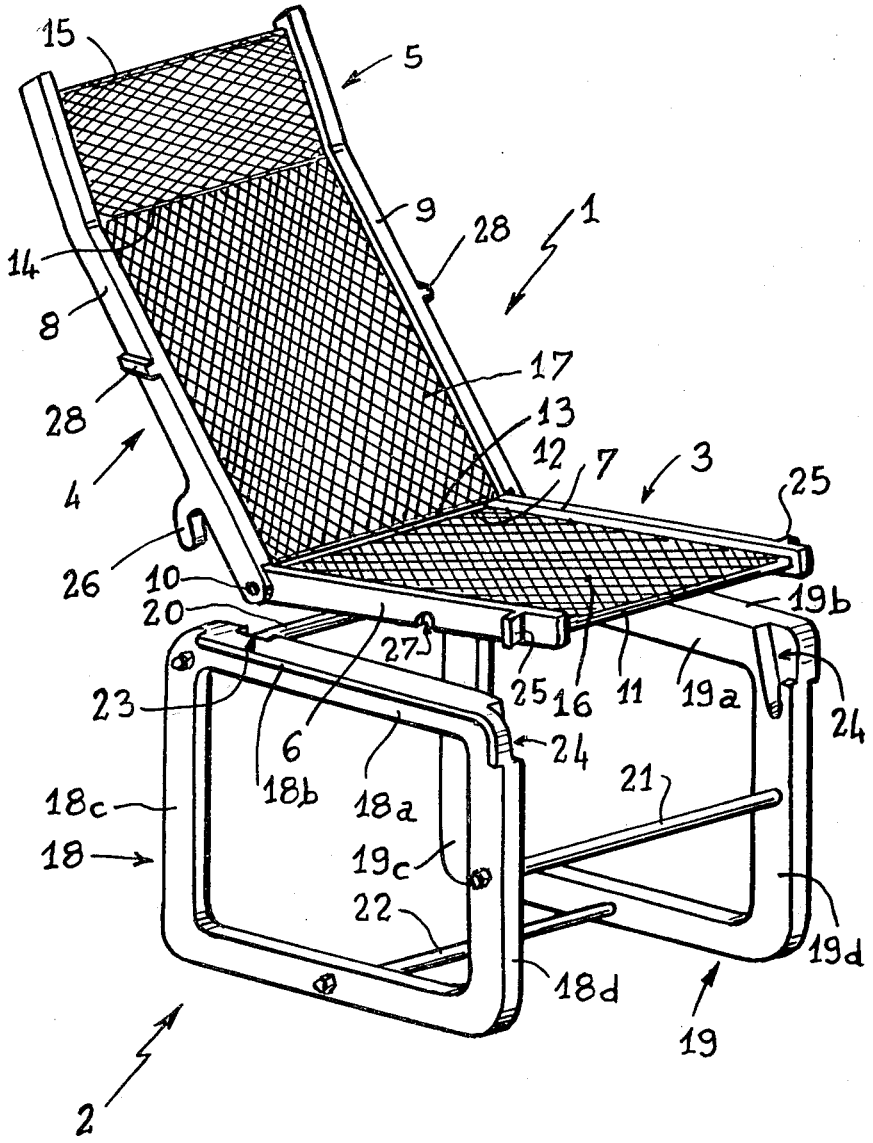
FIG. 1 is a view in perspective of an easy chair according to the invention.

Referring now to the drawings, FIG. 1 shows an easy chair according to the invention, which comprises two main elements, namely an articulated seat 1 and a support 2. The seat is in two parts, namely a seat portion having a surface and a backrest portion 4. It is observed that the latter may be extended upwardly by a headrest 5. The seat portion and the backrest 4 are made by means of two longitudinal elements 6,7 and of two uprights 8,9 respectively, which are both pivoted about a pin 10. Crosspieces referenced 11 to 15 serve to maintain the spaced apart relationship of the longitudinal elements 6,7 and of the uprights 8,9, and sheets 16,17 corresponding to the seat surface 3 and to the backrest 4 can be stretched therebetween. These sheets are preferably made in the form of a net composed of yarns of synthetic material in order to be rot-proof.

The support 2 is composed of two frames 18,19 of rectangular shape, connected by spacers 20, 21 and 22 ensuring their spaced apart relationship. These spacers may be made of any appropriate material, for example of plastics material or stainless metal. The upper side of each frame constitutes an arm or armrest 18*a*, due to a lateral extension 18*b*, 19*b* respectively which considerably widens the upper face of the arm in question. It is observed that each arm 18*a*,19*a* is provided with a notch 23 made in the inner face thereof and which is of limited depth. It will be observed that the notch in question is located to the rear of the arm and near the rear leg 18*c*, 19*c* of each frame 18, 19.

Each arm 18*a*, 19*a* is further provided with a second notch 24 made in its inner face above the front leg 18*d*, 19*d* of each frame. This notch terminates in a tapering lower end, as will be better explained hereinbelow.

Figure 2:
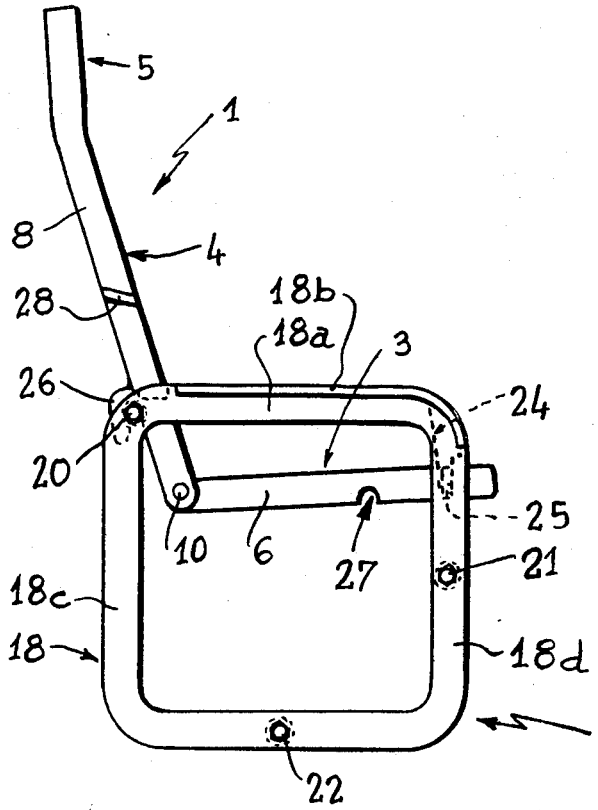
FIGS. 2 and 3 illustrate in side view the two positions of this easy chair.

Each of the longitudinal elements 6,7 of the seat portions 3 is provided with a lateral projection 25 projecting outwardly and having a relatively reduced thickness between its opposed vertical surface so that it may cooperate virtually without lateral clearance with the lower part of the notch 24 of each of the frames 18, 19 of the support 2, as illustrated in FIG. 2. It will be understood that, as the upward opening of this notch is flared, the positioning of the projection 25 is facilitated. The two uprights 8 and 9 of the backrest 4 are provided on their rear face with a hook 26 (FIGS. 1 and 2) adapted to engage around the spacer 20 of the support connecting the two upper rear corners of the two frames. As illustrated in FIG. 2, an easy chair is thus obtained whose seat surface is at such a distance from the ground that the user can easily sit around a table as if it were an ordinary chair.

Figure 3:
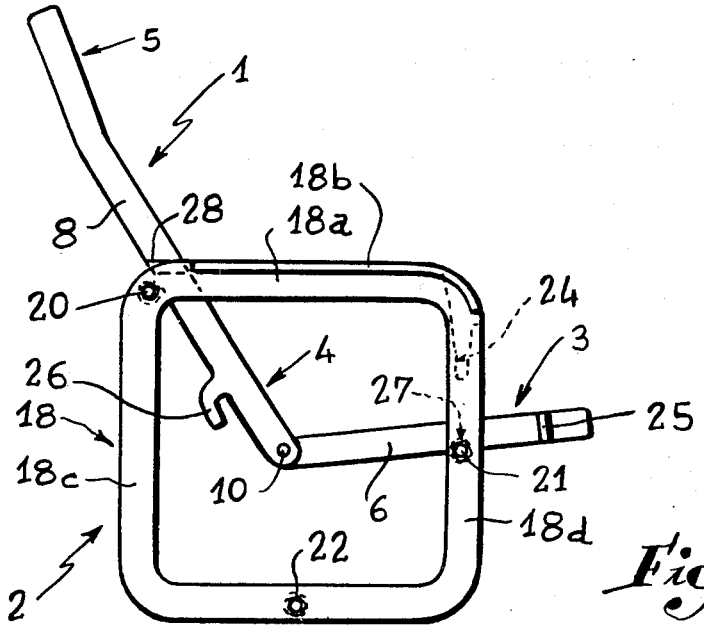

On the contrary, if the user wishes to rest, he/she lifts off the articulated seat 1 by removing the projections 25 from the notches 24 and disengaging the hooks 26 from the spacer 20. The articulated seat is then lowered, the projections 25 being disposed in front of the legs 18*d*, 19*d* of the frames 18, 19 so that they cannot hinder the displacement in question. Notches 27 made in the lower part of the longitudinal elements 6,7 of the seat portion then surround the spacer 21 disposed substantially at the centre of each of the legs 18*d*, 19*d* and therebetween. The hooks 26 having been previously disengaged from the spacer 20, lateral stops 28 borne on the outside of the uprights 8 and 9 are easily brought into the notches 23 (FIG. 3). It will be noted that the backrest 4 and its headrest 5 then form with the seat portion an angle much larger than the one which these elements form when the articulated seat is in the position of FIG. 2.

In order to complete the user's comfort, it is provided to add to the easy chair according to the invention a footrest 29 illustrated in FIG. 4 which comprises two rectangular frames 30, 31 connected at two of their adjacent sides by perforated partitions 32, 33 which are continuously joined together. The width and length of the frames 30, 31 correspond substantially to the height of the seat surface 3 of the easy chair described hereinabove in one or the other of its positions, as illustrated in FIGS. 5 and 6. In other words, the width of the frames in question is such that the user sitting in the easy chair in low position may place his/her legs on the larger of the two faces of the footrest as illustrated in FIG. 5, i.e. on partition 32.

If the footrest 29 is placed with its small side on the ground, the user may stretch his/her legs on the other partition 33 when the easy chair is in high position, as illustrated in FIG. 6.

It will be observed that the frames 30 and 31 diverge away from the partition 32 so that the footrest thus obtained are stackable. Under these conditions, the partition 33 is in the form of an isosceles trapezium.

A two-position easy chair and the footrest which may be used therewith have thus been made simply and economically. All these elements which are preferably made of a moulded plastic material are rot-proof with the result that such furniture can remain outside whatever the weather.

The preceding description has of course been given solely by way of example and in no way limits the field of the invention; whereby replacement of the details of execution described by any other equivalents would not depart from the scope of the invention.

Although the easy chair has been described as having a seat surface and a backrest made of net, the uprights 8 and 9 and longitudinal elements 6 and 7 may form an integral part of a single moulded piece.

What is claimed is:

1. A two-position easy chair comprising:

(a) an articulated seat including a seat portion having longitudinal side elements with front and rear ends, and the seat including a backrest portion having longitudinal uprights with upper and lower ends, the respective side elements and uprights being held together by crosspieces, and the seat portion and backrest portion being articulated together at their respective rear and lower ends;

(b) each longitudinal side element of the seat portion having a lateral projection extending from it near its front end, and each of the uprights having a hook near its lower end and having a lateral stop projecting therefrom between the hook and its upper end;

(c) a support comprising two laterally-spaced vertically disposed rectangular frames held together by horizontally disposed front and rear spacers, the frames receiving the seat and backrest portions between them;

(d) each support frame having a horizontal arm joined to a front and a rear leg, each arm having a first downward notch extending partway thereinto in front of and adjacent to said rear leg, and having a second downward notch extending partway thereinto near the front leg, the front spacer extending between the front legs below the second notches and the rear spacer extending between the rear legs adjacent to the arm; and (e) the articulate seat being supportable in a raised position wherein the lateral projections of the side elements are fitted into the second notches in the arms of the support frame and the uprights of the backrest are supported by their hooks overlying the rear spacer, and the articulated seat being supportable in a lowered position wherein the side elements are supported on the front spacer and the uprights are supported on their lateral stops fitted into said first notches in the arms.

2. In an easy chair as claimed in claim 1, each longitudinal side element of the seat portion having a notch extending up partway into the side element intermediate its ends, and each of these notches engaging the front spacer when the seat is supported in its lowered position.

3. In an easy chair as claimed in claim 1, a net of synthetic material stretched over the longitudinal side members and their crosspieces, and strectched over the uprights and their crosspieces.

4. The combination of an easy chair as defined in claim 1 and a footrest to be placed on the floor in front of the easy chair comprising, a rectangular structure having one side partition corresponding in length with the height above the floor of the seat portion when the easy chair seat is in its raised position, and having a second side partition which corresponds in length with the height above the floor of the seat portion when the easy chair seat is in its lowered position.

5. The combination as claimed in claim 4, wherein the footrest comprises two laterally spaced frames respectively connected together by said one and said second side partitions.

* * * * *